US007024900B2

(12) United States Patent
Knight et al.

(10) Patent No.: US 7,024,900 B2
(45) Date of Patent: Apr. 11, 2006

(54) CONTAINER BEADING

(75) Inventors: Philip John Knight, Narkurs (GB); Alain Presset, Blewbury (GB)

(73) Assignee: Crown Cork & Seal Technologies Corporation, Alsip, IL (US)

( * ) Notice: Subject to any disclaimer, the term of this patent is extended or adjusted under 35 U.S.C. 154(b) by 90 days.

(21) Appl. No.: 10/484,833

(22) PCT Filed: Jul. 17, 2002

(86) PCT No.: PCT/EP02/08075

§ 371 (c)(1),
(2), (4) Date: Jan. 26, 2004

(87) PCT Pub. No.: WO03/009952

PCT Pub. Date: Feb. 6, 2003

(65) Prior Publication Data

US 2004/0168497 A1 Sep. 2, 2004

(30) Foreign Application Priority Data

Jul. 25, 2001 (EP) ..... 01306379

(51) Int. Cl.
*B21D 15/04* (2006.01)

(52) U.S. Cl. ..... 72/105; 72/92; 72/379.4; 72/466.7

(58) Field of Classification Search ..... 72/91, 72/92, 94, 102, 105, 125, 379.4, 466.7
See application file for complete search history.

(56) References Cited

U.S. PATENT DOCUMENTS

| | | | | |
|---|---|---|---|---|
| 4,246,770 | A * | 1/1981 | Franek et al. | 72/92 |
| 4,308,737 | A * | 1/1982 | Kannegiesser et al. | 72/91 |
| 4,389,147 | A * | 6/1983 | Van Alsburg | 413/69 |
| 4,953,376 | A * | 9/1990 | Merlone | 72/57 |
| 5,125,257 | A * | 6/1992 | Worwag et al. | 72/348 |
| 5,899,104 | A | 5/1999 | Bilman et al. | |

FOREIGN PATENT DOCUMENTS

| | | |
|---|---|---|
| JP | 6009028 A | 5/1985 |
| WO | WO 97/49509 | 12/1997 |

* cited by examiner

*Primary Examiner*—Ed Tolan
(74) *Attorney, Agent, or Firm*—Diller, Ramik & Wight

(57) ABSTRACT

Beading of containers such as two and three piece can bodies by rolling the can body between tools, typically a roll/roll or a roll/rail of a rotary turret system. During beading, a load is applied along the central axis of the can body, whereby axial and panel performance of the beaded can is improved. This load is applied for example by the use of miniature air bags which are fixed to the turret.

12 Claims, 5 Drawing Sheets

CONTAINER BEADING

Priority of the above-identified application is based upon PCT/EP02/08075 internationally filed on Jul. 17, 2002 pursuant to 35 U.S.C. § 371.

BACKGROUND OF THE INVENTION

This invention relates to beading and, in particular but not exclusively, to the beading of cans using roll/rail and roll/roll beading systems.

Container body beads are formed by a beading machine of, for example, the rotary turret type, in which a container is mounted on a mandrel and rolled over fixed rail segments progressively to form beads in the container side wall. The beading rail is profiled to form the beads as the can body is forced against the rail. The internal mandrel, or alternative male tool element, has a complementary profile to that of the rail. Alternatively, beads may be formed by the relative motion of external rollers (also referred to simply as "rolls") and an internal mandrel, the container being mounted and freely rotatable on the mandrel.

Can performance is typically quantified in terms of axial collapse and panel performance (distortion from the original, e.g. circular, cross-section under unbalanced external pressure). Whilst conventional beaded cans provide acceptable axial and panel performance, there is a need to improve performance still further in order to enable additional metal savings to be made.

SUMMARY OF THE INVENTION

According to the present invention, there is provided a method of beading a container, the method comprising: mounting a can body on a first tool such that the can body is freely rotatable; moving the can body and first tool into contact with a second tool, such that the can body is clamped between the tools, at least one of the tools including a beading profile; applying a load along the central axis of the can body; and forming circumferential beads in the can body side wall by rolling the can body between the tools, whilst maintaining the positive axial load on the can body.

The Applicant has found that by applying a positive axial load to the can body during the beading operation, axial collapse and panel performances are improved by around 10% over standard beading without compromising can geometry. By a "positive" axial load, it is meant that that load is directed along the longitudinal axis of the can and is a net compressive load, rather than being balanced out by an opposite force, such as a locating force.

Usually the can body has a flange and the method may further comprise holding the flange in a freely rotatable flange support ring. This ring prevents the flange from collapsing and/or overgrowing when under load.

The axial load may be applied either to the flange end of the can body, or to the opposite end. Clearly the opposite end could be the integral base of the can body in a so-called "two-piece" can body, open in a tubular "three-piece" can body, or the can end of a three-piece can body with one closed, typically seamed-on end. Although loading the can body from both ends is, in theory, possible and may generate further benefits in can performance, loading at one end is more practical as this enables conventional beaders to be used.

For can bodies of from 60 to 250 mm in diameter and having a wall thickness of between 40 T (0.102 mm) and 60 T (0.152 mm), where "T" is tenths of thou (thousandths of an inch), the axial load applied may be between 0 N and 900 N, performance benefits being realised over all levels of axial load. However, high loads may lead to unacceptable pull down (reduction in can height) and/or flange growth so that ideally the load may be 600 N or less. Preferably for a can body having a 48 T (0.123 mm) wall thickness, the applied load is from 300 N to 600 N, and for optimum performance benefit may be 600 N. Applied load varies in direct proportion to the wall thickness and clearly applied load may be greater for larger containers having bigger, deeper beads.

In a preferred embodiment for the same 73 mm diameter can body of 48 T (0.123 mm) wall thickness, the bead forming step comprises forming beads of up to 0.0215" (0.546 mm) with a maximum pull-down of approximately 0.04" (1 mm).

According to a further aspect of the present invention, there is provided an apparatus for beading a container, the apparatus comprising: a mandrel for internal support of the can body; a tool for external engagement with the can body, the mandrel and external tool having complementary bead profiles; and means for applying a load along the central axis of the can body during beading of the can body side wall.

The apparatus usually includes a can body carrier, such as a cradle, and a plate for supporting the base of a two piece can body or one end of a three piece can body. The load may be applied via the base plate or, for ease of changing the load to be applied, the load application means may include at least one air bag at the end opposite to the plate, such that the applied load is in line with the central axis of the mandrel. In the latter case, load may be applied by axial movement of the plate whereby the air bags are compressed and provide a reactive axial load on the can body.

A preferred embodiment of the invention will now be described, by way of example only, with reference to the drawings, in which:

DESCRIPTION OF THE PREFERRED EMBODIMENTS

Figure 1:
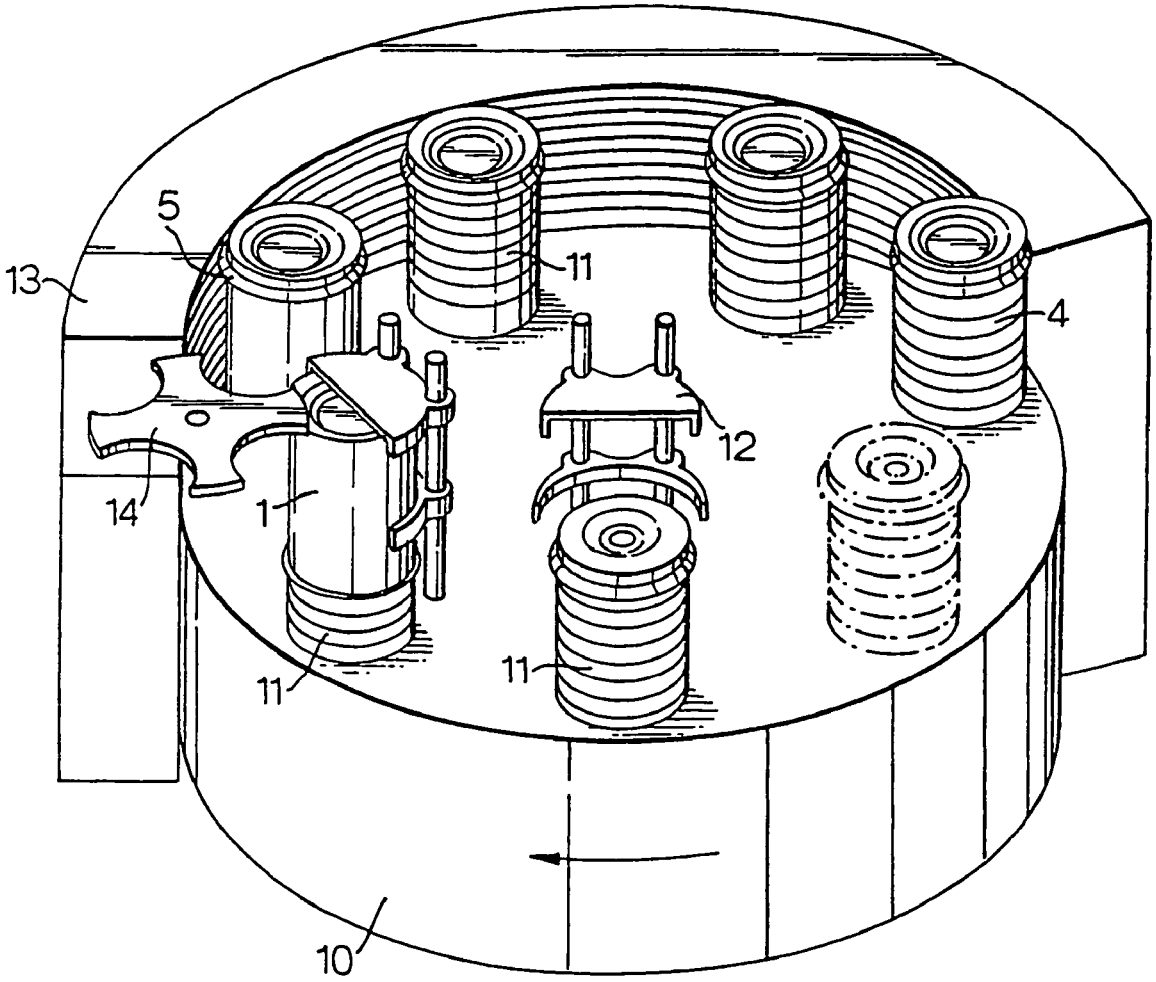
Fig.1. PRIOR ART
FIG. 1 is a schematic perspective view of a prior art apparatus for beading a can body.

The prior art beader of FIG. 1 is of the type described in EP-0006321 and comprises a rotary turret 10 carrying heads, each of which comprises a profiled mandrel 11 which is rotatably mounted on the turret on a shaft (not shown). Can bodies 1 are fed onto the mandrels 11 by infeed star wheel 14 and are initially held in position by cradles 12. As the turret rotates in the direction of the arrow, the can bodies engage a beading rail 13. The shafts of the mandrel are driven so that the mandrels and can bodies mounted thereon roll along the rail 13.

In this prior art beader, metal is drawn in tension from plain wall sections at either end of the can bodies thereby progressively forming one or more beads or clusters of beads 4 and, for two piece can bodies, a rolling bead 5, in the can side wall as bead depth is increased. Beaded cans are discharged by a further starwheel (not shown), leaving the can carrier 12 free to receive the next can body blank.

Figure 2A:
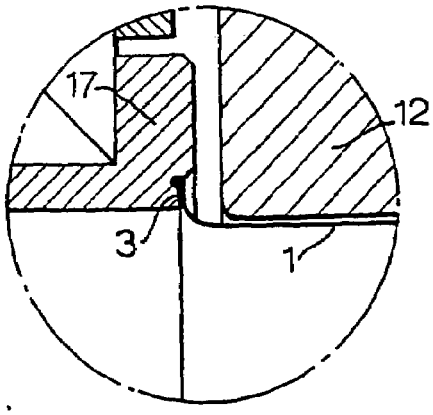
FIG. 2 is a partial side section of a beader with a can body mounted on a profiled mandrel for bead forming.
Figure 2:
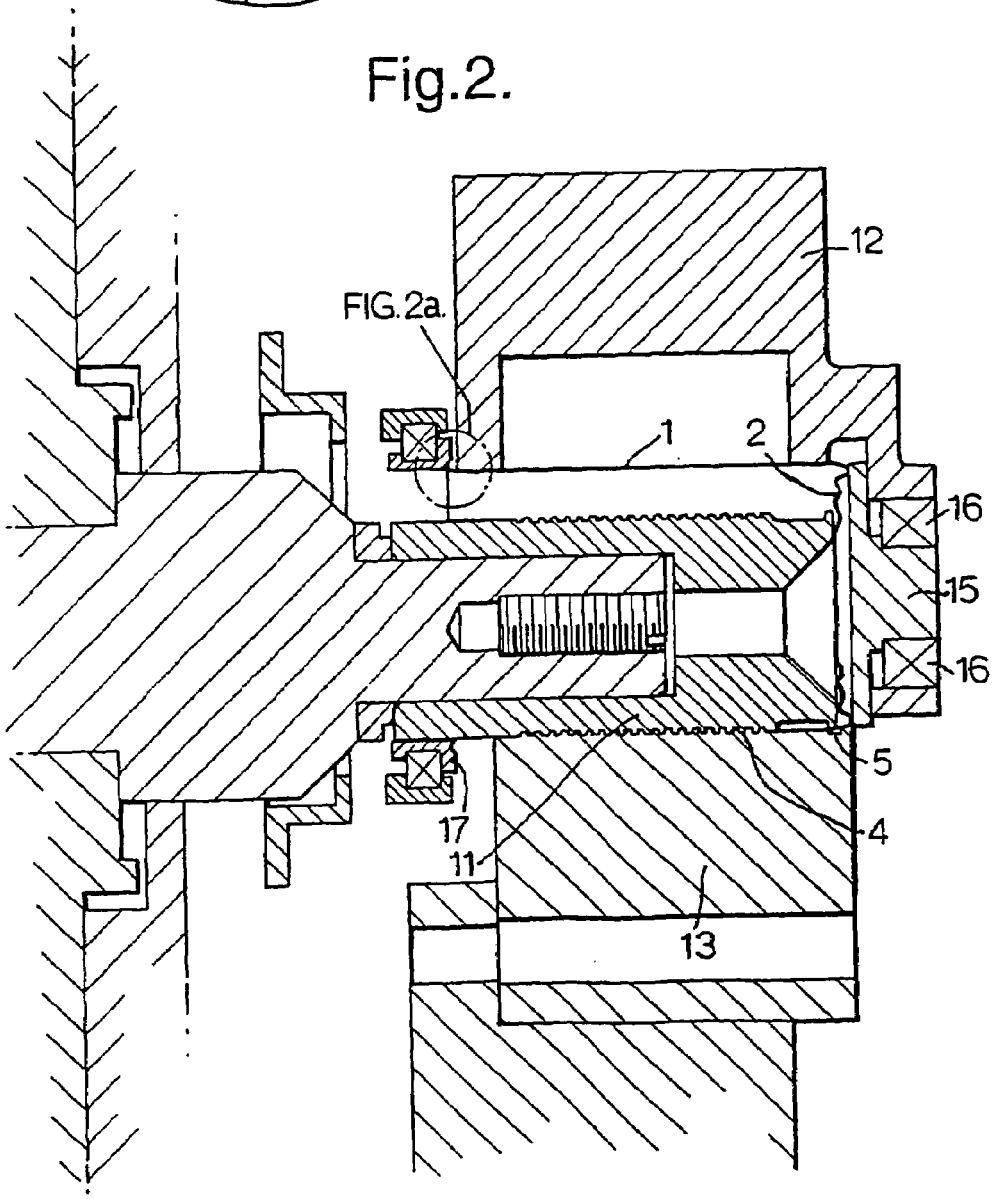

FIG. 2 is a first side view of the axial loading system and shows a two piece can body 1, having an integral base 2 and flange 3 at its open end and mounted on mandrel 11. Bead cluster 4 is formed in the can side wall in conventional manner by rolling the profiled mandrel 11 and can body 1 along the bead forming rail 13. Rolling bead 5 adjacent the can base 2, enables the can body to roll in a straight line during labelling or processing in a reel and spiral cooker, for example and is not required for three piece can bodies.

The base 2 of the can is supported by base plate 15 which is mounted via bearings 16 for free rotation on can carrier cradle 12. During beading, the flange 3 of the can body 1 engages a flange support ring 17 which is connected to the can carrier 12 (best seen in FIG. 2*a*).

Figure 3:
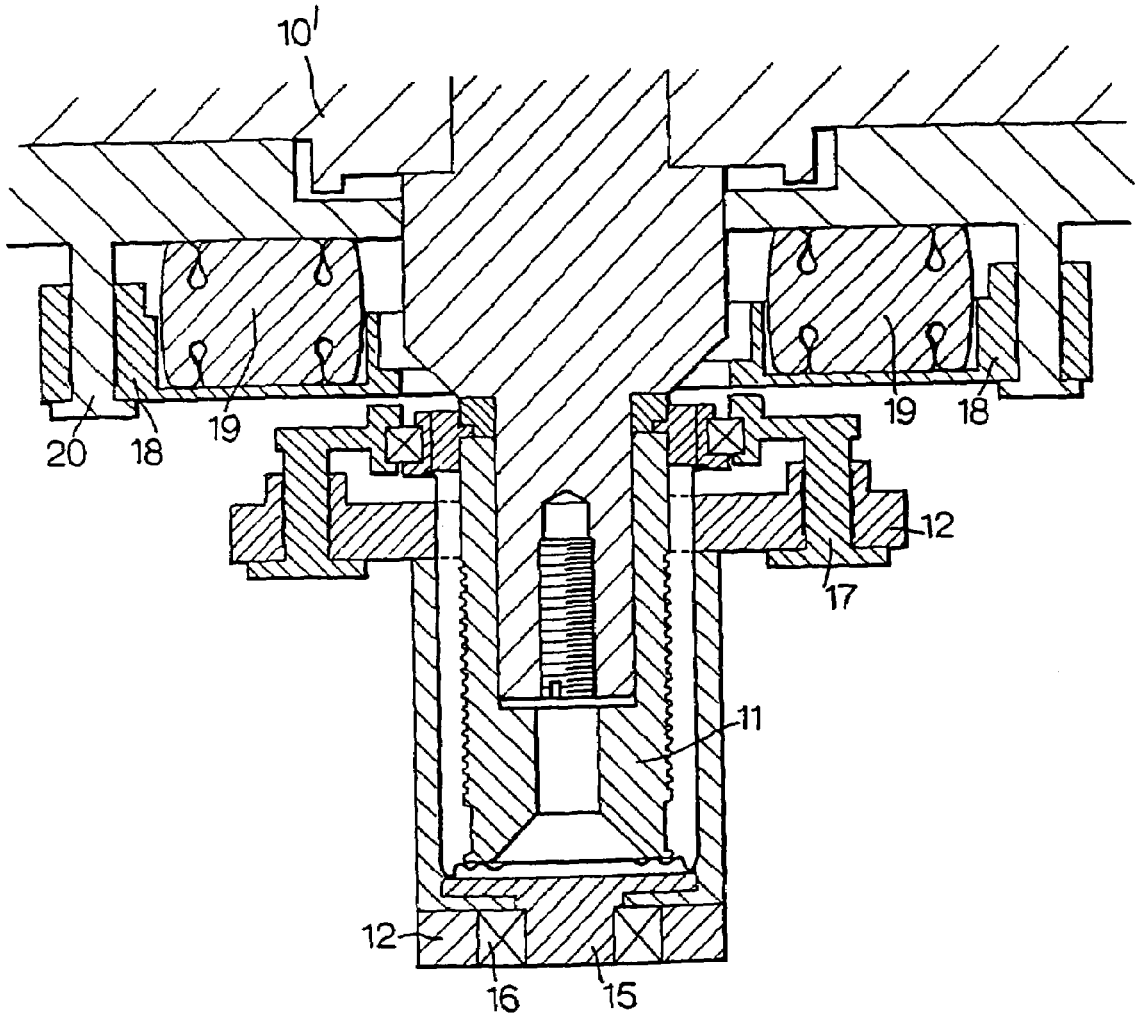
FIG. 3 is a partial side section of the beader, perpendicular to the view of FIG. 2.

FIG. 3 is a second side view of the axial loading system, perpendicular to the view of FIG. 2 and showing the rotary turret 10' and air bags 19, which are held in position by means of yoke plate 18. The can is loaded through its central axis by twin air bags 19 which transfer the load via yoke plate 18 when the plate is engaged by the rotary flange support ring 17 during camming of the can carrier or cradle 12. Movement of the air bags is limited by height stops 20 but both the yoke plate and flange support ring are fully floating in order to ensure evenly distributed load around the can flange.

In contrast with the prior art beader of FIG. 1, in the beader of the present invention, metal from the plain wall sections is drawn in compression due to the applied axial load. Whilst the embodiment shown in the drawings uses air bags to load the system, clearly other biasing devices could be used within the scope of the invention. By using air bags, loads can be easily changed if desired, remain constant throughout the life of the air bag and, by linking each head of the rotary turret machine to a common air supply, are equal on each head.

The progression of movement of the can carrier, flange support ring and yoke plate for application of an axial load to the can body is set out in FIGS. 4 to 9.

Figure 4:
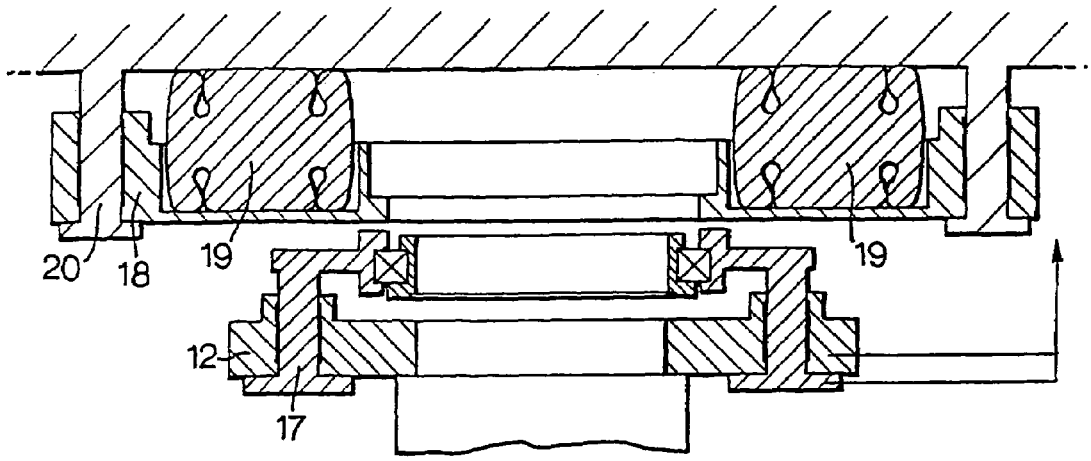
FIGS. 4 to 9 are partial side sections of the can carrier during a typical beading sequence.
Figure 5:
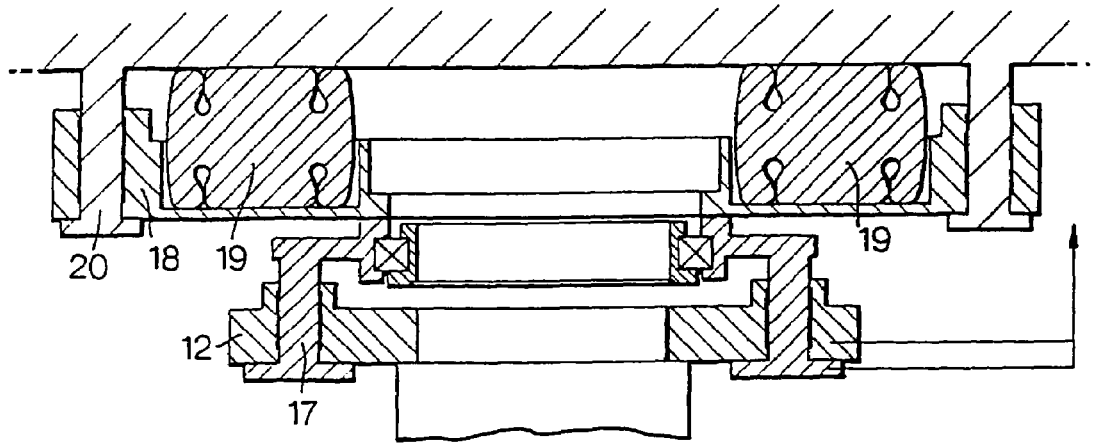
Figure 6:
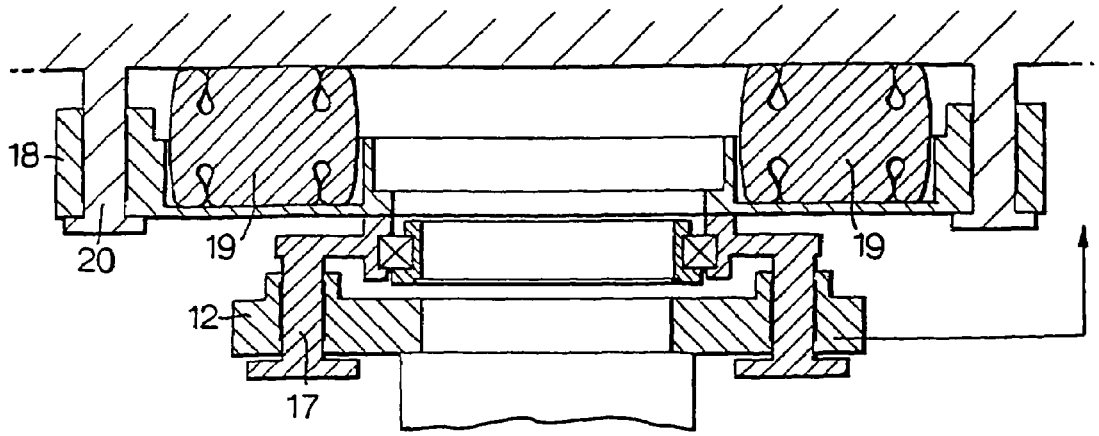

During rotation of the turret, the can carrier 12 and flange support ring 17 cam back towards the turret (upward arrows in the figures) over the profiled mandrel until the flange support ring contacts the yoke plate 18 which retains the air bags in position (FIGS. 4 and 5). In order to clamp the can in position, the carrier continues camming backwards, thereby reducing in height, until the position shown in FIG. 6. The can body which is held in the carrier then engages flange support ring 17. No movement of the yoke plate has occurred at this stage and consequently no loading of the can body.

Figure 7:
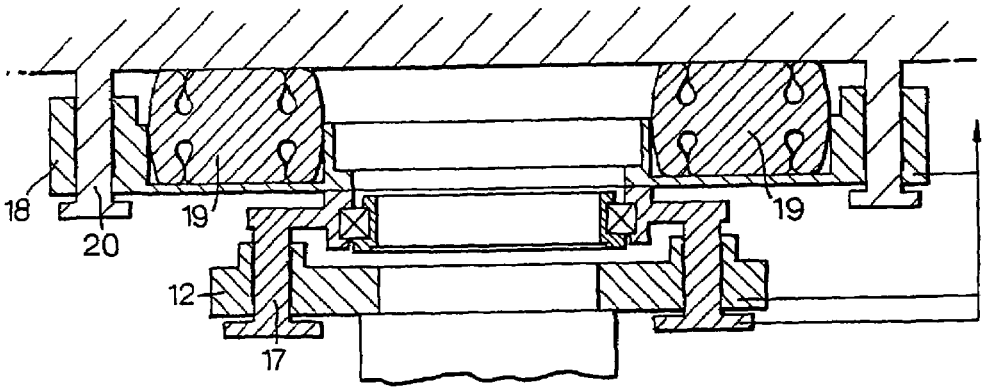

Once the can is clamped in the carrier, the carrier continues camming backwards by typically 3 mm, thereby moving the yoke plate the same distance (FIG. 7). The movement of the yoke plate initiates loading of the can by transferring of the axial load from the air bags. This movement of the yoke plate 18 compresses the air bags 19 and also takes up any slack in the system.

Figure 8:
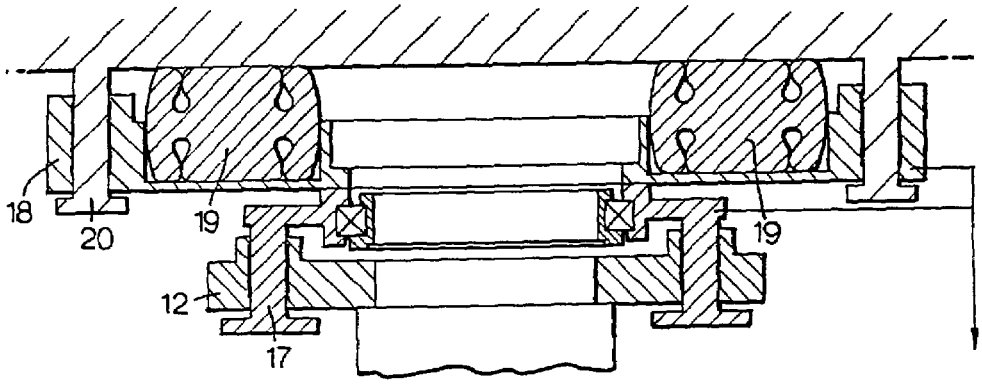
Figure 9:
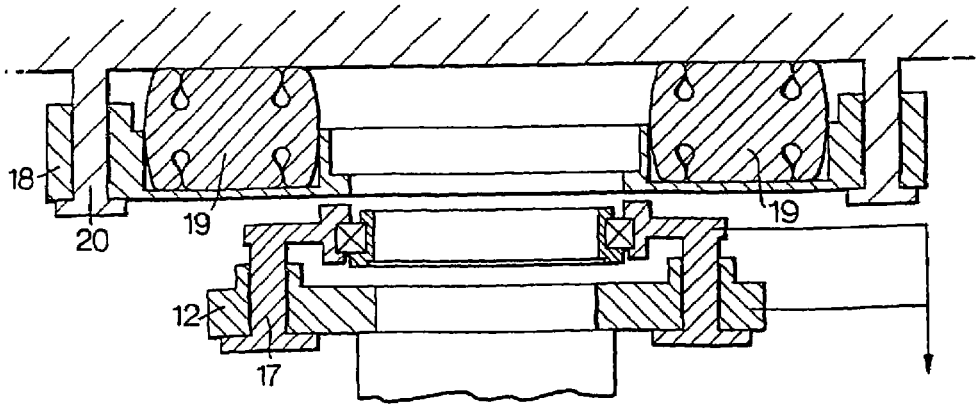

When the can carrier is fully back, as shown in FIG. 7, beading commences. During beading, the can body reduces in height due to the bead formation and the air bags and flange support ring 17 move forward to follow this movement by typically 1 mm to compensate for the pull down (FIG. 8).

After the completion of beading, the carrier 12, and flange support ring mounted on the carrier cam forward (FIG. 9) to discharge the can body. It is clear from FIG. 9 that the carrier 12 has completely disengaged from flange support ring 17.

In the present invention, the compression of the air bags 19 during beading causes the can body to be loaded along its central axis via yoke plate 18 and flange support ring 17, by virtue of the location of the can body flange in the flange support ring.

In the FIGS. 4 to 9, backward movement towards the turret is denoted by an upward arrow and forward movement, away from the turret, by a downward arrow on the relevant moving parts of the apparatus.

EXAMPLE 1

A roll/roll single headed beader was used to quantify the axial and panel performance of a set of cans having a beading profile formed whilst applying an axial load. Each can was free to rotate while being clamped and beaded-and a flange support ring prevented the can flange from collapsing and overgrowing when under load.

Twenty 73 mm diameter×108.5 mm cans of 48 T (0.114 mm) side wall gauge were beaded for each setting, that is:

(i) three different bead depths (shallow 0.016" (0.406 mm), standard 0.0205" (0.521 mm) and deep 0.025" (0.635 mm)); and (ii) axial clamping loads of from 0 to 900N.

A gain of 10% in axial and panel performance over standard beading was found for all given bead depths at 400N axial load. It is believed that by beading under compression, local thinning of the metal was reduced, thereby improving performance. Performance improvements may, however, also be due to geometrical changes. A gain of up to 25% was achieved with high clamping loads but exhibited unacceptable pull down and flange growth above 600N.

EXAMPLE 2

In order to mimic production conditions more closely, the experiment of example 1 was conducted using a rotary turret roll/rail beader similar to that shown in FIG. 1. The present example loaded the can at the flange end only, using the air bag loading system of FIGS. 2 to 8. Can sizes were as in example 1 (i.e. 73 mm diameter×108.5 mm cans, side wall gauge of 48 T (0.213 mm)). 50 samples were tested for each beader setting as follows:

(i) three bead depths (0.018" (0.457 mm), 0.021" (0.533 mm) and 0.024" (0.61 mm)); and (ii) axial loads of 0, 300N, 450N, 600N and 900N.

Axial and panel performance benefits were realised at all levels of axial load, with maximum overall gain of approximately 3–4% over zero load being generated at 600N. Performance gains were more sensitive at shallower bead depths. At a target bead depth of 0.021" (0.533 mm), axial strength increased with axial load to a peak at about 600N load. Panel performance mirrored this improvement in axial performance when an axial load was applied during beading.

Variability of both axial and panel failure was considerably reduced by all axial loading, irrespective of value. Axial loading resulted in increased levels of pull-down than without such loading but this remained within acceptable limits at 0.04" (1 mm) pulldown at 600N axial load. Flange growth at loads up to 600N (inclusive) was insignificant but some growth was experienced at 900N.

The invention has been described by way of example only and changes may be made to the apparatus within the scope of the invention. For example, other methods of loading the system may be used although ideally loading should be carried out through the central axis of the can body. The load may be applied via the flange end or base (opposite to the flange end), or both ends of the can body. The invention is equally applicable to two and three piece can bodies.

Although a preferred embodiment of the invention has been specifically illustrated and described herein, it is to be understood that minor variations may be made in the apparatus without departing from the spirit and scope of the invention, as defined by the appended claims.

The invention claimed is:

1. A method of beading a container comprising the steps of:

mounting a can body (1) on a first tool (11) such that the can body (1) is freely rotatable;

moving the can body (1) and the first tool (11) into contact with a second tool (13) such that the can body (1) is clamped between the first and second tools (11, 13) and at least one of the tools includes a beading profile;

applying an axial load along a central axis of the can body;

forming circumferential beads in a side wall of the can body by rolling the can body between the first and second tools (11, 13);

the can body having a diameter of from substantially 60 to 250 mm, a can wall thickness of from substantially 40T (0.102 mm) to 60T (0.152 mm) and the applied axial load ranging between substantially 300 N to 600 N; and applying the axial load as a positive axial, net compressive load on the can body and maintaining the positive axial, net compressive load on the can body during bead formation.

2. The method as defined in claim 1 wherein the can body has a flange and the method further includes the step of holding the flange in a flange support ring (17).

3. The method as defined in claim 2 wherein the positive axial, net compressive load is applied to at least one of the flange end, an opposite end, and to both ends of the can body.

4. The method as defined in claim 1 wherein the bead forming step includes forming beads of up to substantially 0.0215" (0.546 mm) with a maximum pull-down of substantially 0.04" (1 mm).

5. The method as defined in claim 2 wherein the bead forming step includes forming beads of up to substantially 0.0215" (0.546 mm) with a maximum pull-down of substantially 0.04" (1 mm).

6. The method as defined in claim 3 wherein the bead forming step includes forming beads of up to substantially 0.0215" (0.546 mm) with a maximum pull-down of substantially 0.04" (1 mm).

7. An apparatus for beading a container comprising:

a first roll (11) for supporting a can body (1) such that the can body is freely rotatable on the first roll (11);

one of a fixed rail (13) and a second roll having complementary bead profiles; and means for applying a positive axial, net compressive load of from substantially 300 N to 600 N along a central axis of the can body during beading of a side wall of the can body.

8. The apparatus as defined in claim 7 wherein the load application means includes at least one air bag (19).

9. The apparatus as defined in claim 7 wherein the load application means includes at least one air bag (19) in line with the central axis of the can body.

10. A method of beading a container comprising:

mounting a can body on a first tool such that the can body is freely rotatable;

moving the can body and first tool into contact with a second tool, such that the can body is clamped between the first and second tools and at least one of the tools including a beading profile;

applying a load along a central axis of the can body;

forming circumferential beads in a side wall of the can body by rolling the can body between the tools while maintaining the positive axial load on the can body, the can body diameter being from 60 to 250 mm, the can wall thickness being between 40T (0.102 mm) and 60T (0.152 mm) and the axial load applied being between 0 N and 900 N; and during the bead forming, step forming beads of up to 0.0215" (0.546 mm) with a maximum pull-down of approximately 0.04" (1 mm).

11. A method of beading a container comprising:

mounting a can body on a first tool such that the can body is freely rotatable;

moving the can body and first tool into contact with a second tool, such that the can body is clamped between the first and second tools and at least one of the tools including a beading profile;

applying a load along a central axis of the can body;

forming circumferential beads in a side wall of the can body by rolling the can body between the tools while maintaining the positive axial load on the can body, the can body diameter being from 60 to 250 mm, the can wall thickness being between 40T (0.102 mm) and 60T (0.152 mm) and the axial load applied being 600 N or less; and during the bead forming, step forming beads of up to 0.0215" (0.546 mm) with a maximum pull-down of approximately 0.04" (1 mm).

12. An apparatus for beading a container comprising:

a first roll for supporting a can body such that the can body is freely rotatable on the roll;

a fixed rail or second roll;

means for applying a load along the central axis of the can body during beading of a side wall of the can body; and the load application means including at least one air bag in line with a central axis of the can body.

* * * * *